United States Patent [19]

Sedivec

[11] Patent Number: 4,562,416

[45] Date of Patent: Dec. 31, 1985

[54] TRANSITION FROM STRIPLINE TO WAVEGUIDE

[75] Inventor: Darrel F. Sedivec, Lawrence, Mass.

[73] Assignee: Sanders Associates, Inc., Nashua, N.H.

[21] Appl. No.: 615,620

[22] Filed: May 31, 1984

[51] Int. Cl.[4] ..... H01P 5/107

[52] U.S. Cl. ..... 333/26; 333/246

[58] Field of Search ..... 333/21 R, 26, 246, 247

[56] References Cited

U.S. PATENT DOCUMENTS

| | | | |
|---|---|---|---|
| 2,829,348 | 4/1958 | Kostriza et al. | 333/26 |
| 3,579,149 | 5/1971 | Ramsey . | |
| 3,732,508 | 5/1973 | Ito et al. . | |
| 3,924,204 | 12/1975 | Fache et al. . | |
| 3,969,691 | 7/1976 | Saul . | |
| 4,011,566 | 3/1977 | Honda . | |
| 4,017,864 | 4/1977 | Proctor . | |
| 4,197,545 | 4/1980 | Favaloro et al. . | |

FOREIGN PATENT DOCUMENTS

| | | | |
|---|---|---|---|
| 2462787 | 2/1981 | France | 333/26 |

*Primary Examiner*—Paul Gensler

*Attorney, Agent, or Firm*—Louis Etlinger; Stanton D. Weinstein

[57] ABSTRACT

A waveguide-to-stripline transition includes a stripline portion (14) that fits over an opening in one end of waveguide (12). The stripline portion has a cavity defined by an upper ground-plane conductor (20), a lower ground-plane conductor (22), and a rectangular arrangement of plated-through holes (28) that electrically connect the upper ground-plane conductor (20) to the lower ground-plane conductor (22). The upper ground-plane conductor (20) is etched to provide an aperture (32) with a conductive crosspiece (34) extending longitudinally across it. A plated-through hole (36) connects the crosspiece (34) to the center conductor (26) to provide a T-shaped feed element in the cavity. As compared with prior-art waveguide-to-stripline transitions, this transition is mechanically stronger and has higher power-handling capability.

3 Claims, 1 Drawing Figure

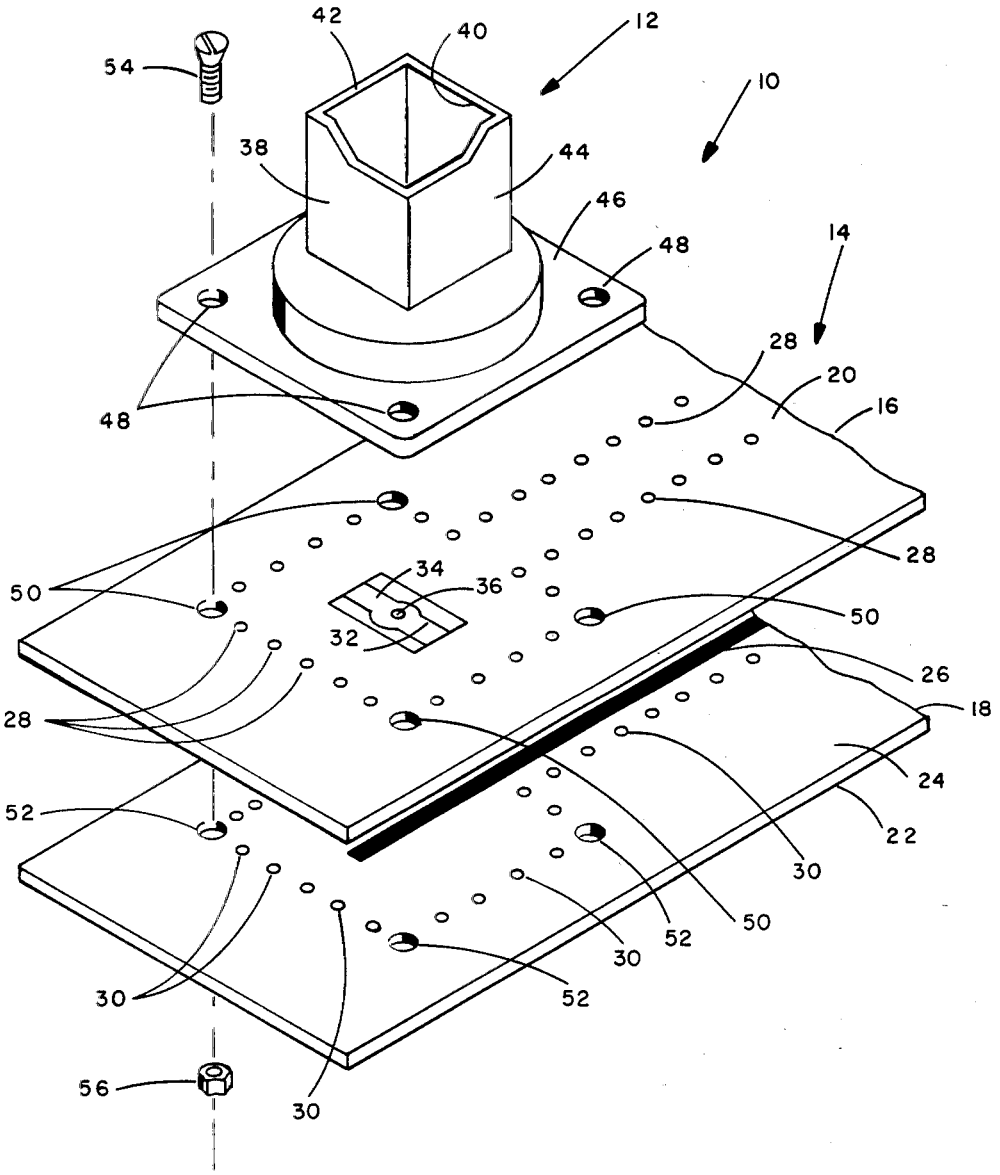
42
40
12
54
10
38
44
46
48
14
28
20
16
48
28
34
36
50
50
32
26
28
18
24
52
22
30
52
50
30
30
52
56
30

TRANSITION FROM STRIPLINE TO WAVEGUIDE

BACKGROUND OF THE INVENTION

The present invention is directed to microwave couplers or transition devices. In particular, it is directed to a transition between a waveguide and a stripline.

Two of the commonly used propagation media for microwaves are waveguides and striplines. A waveguide is often a hollow rectangular conduit in which microwaves are intended to propagate in the $TE_{10}$ mode. In this mode of propagation, the direction of the electric-field vector is the direction perpendicular to the broad walls of the waveguide and normal to the direction of propagation, while the magnetic-field vectors have components in the direction of propagation.

A stripline typically is made of two parallel ground-plane conductors between which dielectric layers are disposed. Between the dielectric layers is a relatively narrow conductor disposed midway between the planes of the ground-plane conductors and extending in the direction of propagation. The electric-field lines extend from the center conductor to the ground-plane conductors and vice versa. The ground-plane conductors extend much farther in the direction transverse to the path of propagation than does the center conductor, and the electric-field distribution at the surface of the center conductor approximates the field distribution in a coaxial cable. Accordingly, microwaves traveling through a stripline propagate in a TEM mode, in which both the electric field and the magnetic field are perpendicular to the direction of propagation.

It is sometimes desirable to employ waveguides as the propagation media in some parts of a microwave system and to employ striplines in others. It is therefore necessary to provide transitions between the two media.

In the past, such transitions have typically employed probes that extend from the stripline partway into the waveguide through a rectangular slot either in one of the broad walls of the waveguide or in a shorting plate at the end of the waveguide. In both cases, the probe is provided by cutting away a portion of the stripline to leave a narrow portion that can extend through the slot. At the end of this narrowed portion, which extends into the interior of the waveguide, the ground planes are removed to leave only the center conductor as the probe.

Such transitions yield good matching characteristics through a reasonable range of frequencies. However, they limit the power-handling capability of the system because the probes tend to arc at higher power levels.

Additionally, the transition can be a weak mechanical link in the system. The narrowed stripline section that extends into the slot in the waveguide is weaker mechanically than the waveguide or the larger sections of stripline, and this makes the transition subject to damage when it is not handled carefully.

It is accordingly an object of the present invention to provide a transition between waveguide and stripline propagation that imposes less of a power limitation than previous transitions do. It is a further object to provide a transition that is stronger mechanically.

SUMMARY OF THE INVENTION

The foregoing and related objects are achieved in a coupler that includes a waveguide with an opening at one end that is covered by a Tee-fed-slot stripline antenna. The stripline antenna includes the usual two parallel ground-plane conductors. One of them abuts the waveguide at its opening and has an aperture for communication with the waveguide interior. Shorting elements extend between the two ground-plane conductors and surround the aperture to form a cavity defined by the shorting elements and the planes of the ground-plane conductors. The center conductor of the stripline ends in a T-shaped feed element whose stem is disposed between and parallel to the two ground-plane conductors and extends into the cavity. The crosspiece of the T-shaped feed element extends longitudinally across the aperture in the ground-plane conductor and is shorted to the ground planes at its ends.

Typically, the waveguide has a flange at its end that is attached to the ground plane that has the aperture. This results in a strong mechanical arrangement since there is no need to narrow the stripline portion of the coupler. Furthermore, this arrangement does not impose as great a power limitation as previous arrangements do, because the probe does not have tips that lie in positions of high electric field.

BRIEF DESCRIPTION OF THE DRAWINGS

These and further features and advantages of the present invention are described in connection with the accompanying drawing, which is an exploded view of a waveguide-to-stripline transition of the present invention.

DETAILED DESCRIPTION OF THE PREFERRED EMBODIMENTS

The illustrated embodiment of the present invention is a coupler 10 that includes a waveguide portion 12 and a stripline portion 14. The stripline portion includes two dielectric sheets 16 and 18, which extend generally parallel to each other. The upper surface 20 of dielectric sheet 16 is plated with copper to provide an upper ground-plane conductor, while the lower surface 22 of sheet 18 is similarly plated. On the upper surface 24 of the lower dielectric sheet 18 is deposited a narrow copper strip 26. This is the center conductor of the stripline, and the electric-field lines of the propagating microwaves extend from the center conductor 26 to the upper and lower ground-plane conductors 20 and 22.

A rectangular arrangement of plated-through holes 28 in the upper dielectric sheet 16 and similar holes 30 in the lower dielectric sheet 18 provide a conductive connection between the two ground-plane conductors 20 and 22 and define with them a rectangular cavity of the type described in U.S. Pat. No. 4,197,545 to Favaloro et al., which is incorporated herein by reference.

Like the Favaloro et al. device, the stripline section of the present invention has its upper conductor 20 etched to remove copper and provide an elongated aperture 32 that opens into the stripline cavity. Copper is not removed from the entire aperture, however; a copper crosspiece strip 34 remains and extends longitudinally across the aperture. A plated-through hole 36 is provided in the middle of the crosspiece 34 and extends through the dielectric sheet 16 to make a conductive connection to center conductor 26. Thus, a T-shaped feed element is provided by the combination of the center conductor 26, the crosspiece 34, and the plated-through hole 36. The function performed by this T-shaped feed element is the same as that performed by the T-shaped feed element of the Favaloro et al. arrangement, although the crosspiece in the Favaloro et al. arrangement is coplanar with the center conductor, while the crosspiece of the illustrated embodiment is coplanar with the upper ground-plane conductor.

It can thus be seen that the stripline section 14 is, by itself, equivalent to the stripline slot antenna described in the Favaloro et al. patent. According to the present invention, however, this antenna is used as part of a waveguide-to-stripline coupler. The waveguide section 12 includes a waveguide consisting of a pair of wide walls 38 and 40 and a pair of narrower walls 42 and 44. The electromagnetic wave propagates along the waveguide with its electric field extending perpendicular to the direction of propagation and parallel to walls 42 and 44. The electric field drops off to zero at walls 42 and 44 and is most intense midway between them.

The end of the waveguide section 12 is provided with a flange 46 that surrounds an opening in the end of the waveguide and has four holes 48 that register with similar holes 50 and 52 in the upper and lower dielectric sheets 16 and 18, respectively. Bolts 54 extend through holes 48, 50, and 52 and are secured by nuts 56 to hold the waveguide solidly in place on the stripline section 14 with the aperture 32 in communication with the interior of the waveguide through the opening at its end, the long edge of the aperture 32 being parallel to the broad wall of the waveguide.

It is clear that this arrangement results in a strong mechanical structure. The waveguide 12 abuts the flat face of the upper ground plane conductor 18, and there are no narrow regions of the stripline to cause weaknesses in the structure. Furthermore, those skilled in the art will recognize that the power-handling capability of the illustrated transition is relatively high because the T-shaped feed element consisting of crosspiece 34, plated-through hole 36, and center conductor 26 has no sharp corners in the high-field-strength region and so is less susceptible to arcing. The illustrated transition thus represents a significant advance in the art.

I claim:

1. A coupler for microwave coupling between a waveguide and a stripline, the coupler comprising:

A. a waveguide of elongated rectangular cross section having an opening at one end;

B. a first generally planar ground-plane conductor covering the opening of the waveguide and forming an elongated aperture communicating with the waveguide interior through the waveguide opening;

C. a second generally planar ground-plane conductor spaced apart from the first ground-plane conductor and extending generally parallel to it;

D. shorting elements extending between the ground-plane conductors to connect them together and surrounding the aperture in the first ground-plane conductor to form a cavity defined by the ground-plane conductors and the shorting elements; and E. a feed line including a generally T-shaped feed element having a stem that extends between and generally parallel to the ground-plane conductors and into the cavity and having a crosspiece extending longitudinally of the aperture and shorted to the ground planes at its ends.

2. A coupler as defined in claim 1 wherein the waveguide includes a flange around the opening, the flange abutting the first ground-plane conductor and being fastened to it.

3. A coupler as defined in claim 1 wherein the crosspiece of the feed conductor is integral and coplanar with the first ground-plane conductor, the feedline further including conductor means extending from the plane of the crosspiece to that of the stem and connecting the stem and crosspiece electrically.

* * * * *